United States Patent [19]

Coenraets

[11] Patent Number: 4,884,617

[45] Date of Patent: Dec. 5, 1989

[54] ROLL-UP SHUTTER STRUCTURE

[76] Inventor: Benoit J. Coenraets, Oude Leuvense Baan 1, B, 1980 Tervuren, Belgium

[21] Appl. No.: 135,089

[22] Filed: Dec. 18, 1987

[30] Foreign Application Priority Data

Dec. 23, 1986 [BE] Belgium ..... PVO/217588

[51] Int. Cl.[4] ..... E06B 9/38

[52] U.S. Cl. ..... 160/271; 160/190; 160/310

[58] Field of Search ..... 160/271, 272, 273.1, 160/133, 310, 189, 188, 190

[56] References Cited

U.S. PATENT DOCUMENTS

| | | | |
|---|---|---|---|
| 1,694,314 | 12/1928 | Dixson | 160/273.1 |
| 1,786,054 | 12/1930 | Dixson | 160/273.1 |
| 3,116,097 | 12/1963 | Novales . | |
| 3,237,682 | 3/1966 | Davis | 160/133 X |
| 3,512,302 | 5/1970 | Sivin et al. | 160/310 X |
| 3,878,879 | 4/1975 | Manns | 160/273.1 |
| 3,981,343 | 9/1976 | DeVito | 160/133 X |
| 4,398,585 | 8/1983 | Marlow | 160/271 X |
| 4,478,268 | 10/1984 | Palmer | 160/272 X |
| 4,563,034 | 1/1986 | Lamb | 160/266 X |
| 4,586,552 | 5/1986 | Labelle | 160/133 |
| 4,601,320 | 7/1986 | Taylor | 160/271 |
| 4,690,195 | 9/1987 | Taylor | 160/271 X |

FOREIGN PATENT DOCUMENTS

| | | |
|---|---|---|
| 0033199 | 8/1981 | European Pat. Off. . |
| 3222770 | 12/1983 | Fed. Rep. of Germany . |
| 2373663 | 7/1978 | France . |
| 2447450 | 8/1980 | France . |
| 192088 | 7/1937 | Switzerland . |

*Primary Examiner*—Alvin C. Chin-Shue
*Assistant Examiner*—David M. Purol
*Attorney, Agent, or Firm*—Cushman, Darby & Cushman

[57] ABSTRACT

A device having a shutter windable around a spindle and especially adapted to close a bay or other opening by the unwinding of the shutter, the same having flexible side edges which project beyond the shutter plane and which are retained with reduced friction in substantially continuous guideways during the unwinding and winding up of the shutter, that shutter edges may disengage from their guideways when subjected to a predetermined pull transversely to guideway. Each guideway has near and upstream of the shutter spindle an access passage through which the projecting edge of any shutter which has disengaged from the guideway can reengage, as the shutter winds around its spindle, in that part of the particular guideway concerned which is disposed beyond the passage.

27 Claims, 5 Drawing Sheets

ROLL-UP SHUTTER STRUCTURE

This invention relates to a device having a shutter windable around a spindle especially adapted to close a bay or other opening by the unwinding of the shutter.

One of the main objects of this invention is to provide a device of the kind hereinbefore set out which is of very simple design and construction and highly reliable.

To this end, the shutter of the device according to the invention has flexible side edges which project beyond the shutter plane and which are retained with reduced friction in substantially continuous guideways during the unwinding and winding - i.e., winding-on - of the shutter.

Advantageously, the projecting edges are embodied by a series of small flexibly interconnected substantially rigid and substantially identical blocks so that the projecting edges can wind spirally around the spindle.

Very advantageously, means are provided at least at the height of the bottom part of the bay to enable the shutter edges to disengage from their guideways when subjected to a predetermined pull transversely to guideway length, notably substantially in the shutter plane.

In an embodiment of the invention, each guideway has in its top part an access passage through which the projecting edge of any shutter which has disengaged from the guideway can re-engage, as the shutter winds around its spindle, in that part of the particular guideway concerned which is disposed beyond the passage.

The invention also relates to a device having a shutter windable on a drum around a shaft and especially adapted to close a bay or other opening by unwinding of the shutter.

According to the invention, the latter device comprises a wheel rigidly secured to one of the free ends of the shaft, the same extending laterally beyond the drum, wheel diameter being less than drum diameter, a counterweight so co-operating with the wheel as to rise when the shutter unwinds and to descend when the shutter winds on to the drum, damping means being provided to retard shutter movement a little before the shutter reaches its fully wound and fully unwound positions.

Further details and features of the invention will become apparent from the following exemplary and non-limitative description of an embodiment of the invention, reference being made to the accompanying drawings wherein.

Like references denote like elements throughout the drawing.

Figure 1:
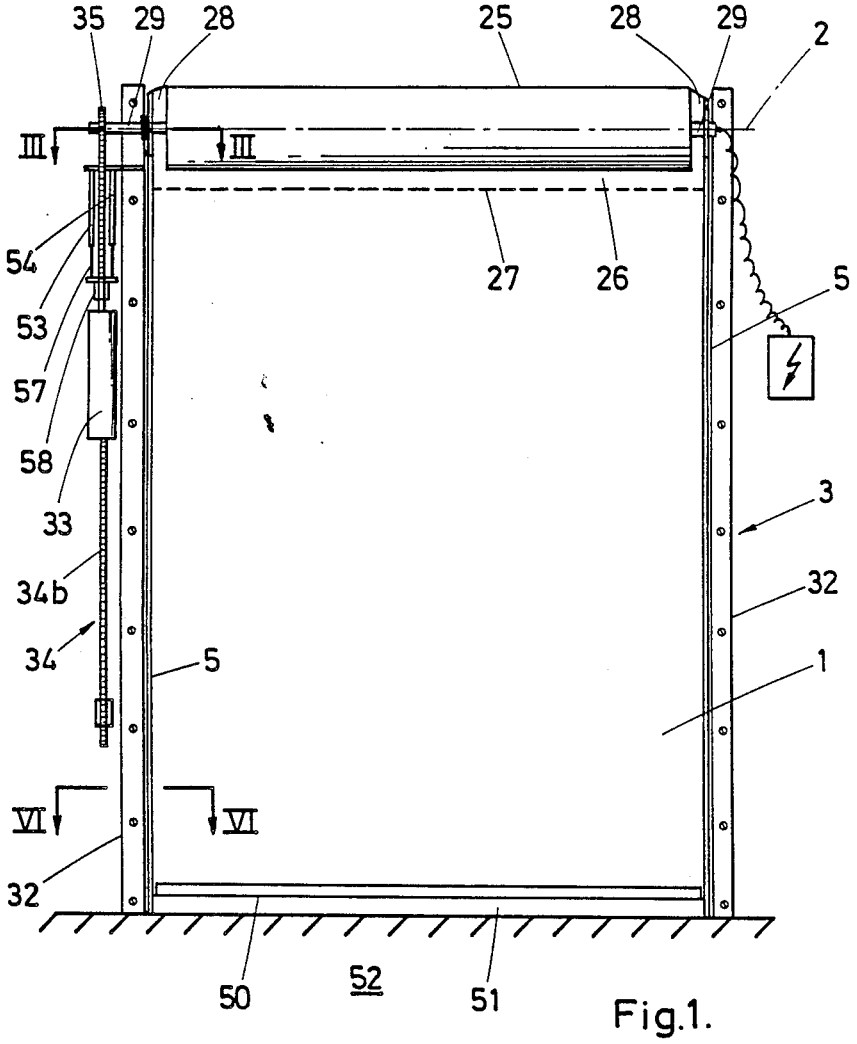
FIG. 1 is an overall diagrammatic view in front elevation, with parts broken away, of the embodiment.

The device according to the invention, an embodiment of which is shown in the accompanying drawings, comprises a shutter 1 adapted to be wound - i.e., wound on - around a spindle 2 and adapted to close a bay 3 or any opening or passage by unwinding of the shutter.

The word "shutter" is to be understood for the purposes of the invention as referring to any element adapted to be wound - i.e., wound-on - around a spindle, such as a tarpaulin, set of pivoted slats or the like.

However, there is a definite preference for flexible shutters in the form, for example, of a tarpaulin.

The description given hereinafter has therefore been limited to a corresponding embodiment of the invention.

In general the device according to the invention is distinguished in that the shutter 1 has flexible side edges having a part 4 which projects beyond the shutter plane and which is retained with reduced friction in substantially continuous guideways 5 so as to be movable therein when the shutter 1 unwinds and winds.

Advantageously the part 4 is in the form of a series of small flexibly interconnected identical rigid blocks 6 enabling the shutter side edges to wind in a spiral around the spindle 2.

The blocks 6 can be made of a rigid plastics moulded on a fabric strip 1' which is secured to the tarpaulin edge and of which, for example, the shutter is made, at a distance apart from one another such that any two consecutive blocks can pivot relatively to one another and thus wind the shutter side edges around the spindle 2.

In practice it is preferred to have blocks 6 formed by what are known as "the meshes" of a conventional slide fastener.

The projecting part 4 of the shutter side edges can therefore be embodied by one of the two lines of such a slide fastener. This is one of the features clearly shown in FIG. 4.

Each guideway 5 has two longitudinal edgings 7, 8 which extend on either side of the shutter side edges, more particularly of the part 4. The edgings 7, 8 face one another so as to engage to some extent around the part 4 which is retained in the guideway 5.

In the embodiment illustrated each guideway 5 comprises two separate section members 9, 10 which extend some distance in side-by-side relationship to one another while being retained by way of their base 11 in a support 12.

A part 13 of the members 9, 10 extends beyond the support 12 and has the longitudinal edgings 7, 8.

More particularly, the two section members 9, 10 have a substantially Z-shaped cross-section, one of the arms forming the edging 7, 8, while the other forms the base 11. The support 12 takes the form of a channel-section member 37 whose arms have facing edgings 14, 15 resembling the shape of a C. The two Z-section members 9, 10 are retained by three intermediate members 16 - 18 clamped between the support 12 and the members 9 and 10 and also between the members 9 and 10. The height of the edgings part 13 which extends beyond the support 12 can be adjusted by altering the thicknesses of the members 16, 17.

To this end, it may be important for the gap d between the base of the channel-section member 12 and the edgings 14, 15 thereof to be greater than the thickness of the arms 11 of the members 9, 10.

Advantageously, the two members 9, 10 are made of plastics, preferably a self-lubricating plastics, whereas the support 12 is, with advantage, a metal section member.

Also, the part 13 has some resilience so that the blocks 6 on the shutter side edges can disengage from their guideway 5 in response to a critical pull athwart the length of the blocks 6, i.e., substantially in the shutter plane. This feature is shown clearly in FIG. 8, in which the direction of the pull is indicated by an arrow 19.

High reliability is therefore ensured, ensuring that the device cannot be damaged in very severe storms and in particular when the shutter is knocked by a vehicle when, for example, in its closed or partly closed position.

The support 12 is positioned in another channel-section member 40 stiffer and wider than that of the channel 37 and secured by screws (not shown) or by welding to a frame 32 arranged on the edges of the bay 3 (see FIGS. 2 and 6–8), a gap 38 being left on either side of the channel 37 between its side walls and the side walls 41 of the member 40.

A clamping element 36, in the form of a cylindrical metal tube in the present case, extends along the support 12 and bears, with a force adjustable at least laterally, on the support 12 so that the distance between the edges 14 and 15 and, therefore, the strength of the pull necessary to disengage the shutter edges 4 from the guideway 5 can be adjusted.

More particularly, the tube operative as clamping element 36 is engaged laterally and to some extent to some depth in the gap 38 and is secured by screws 39 which extend right through the tube to the base 42 of the channel 40. The outside diameter of the tube 36 is greater than the distance between an arm of the support 12 and the channel side wall 41 disposed opposite such arm so that when the screws 39 are tightened the support 12 experiences a force having one component directed towards the channel base 42 and another component operative in a direction parallel to the base 42 and towards the latter arm.

In this connection the screws 39 are secured adjustably in tapped apertures 43 in the channel base 42.

Consequently, by means of the two tubes 36 disposed on either side of the support 12 the same can be secured releasably and adjustably to the channel-section member 40 and the distance between the free ends of the edgings 14, 15 and the support 12 and, therefore, the gap and, possibly, the pressure between the members 9, 10 and the projecting shutter edges 4 can be adjusted by tightening or slackening the screws 39.

Figure 4:
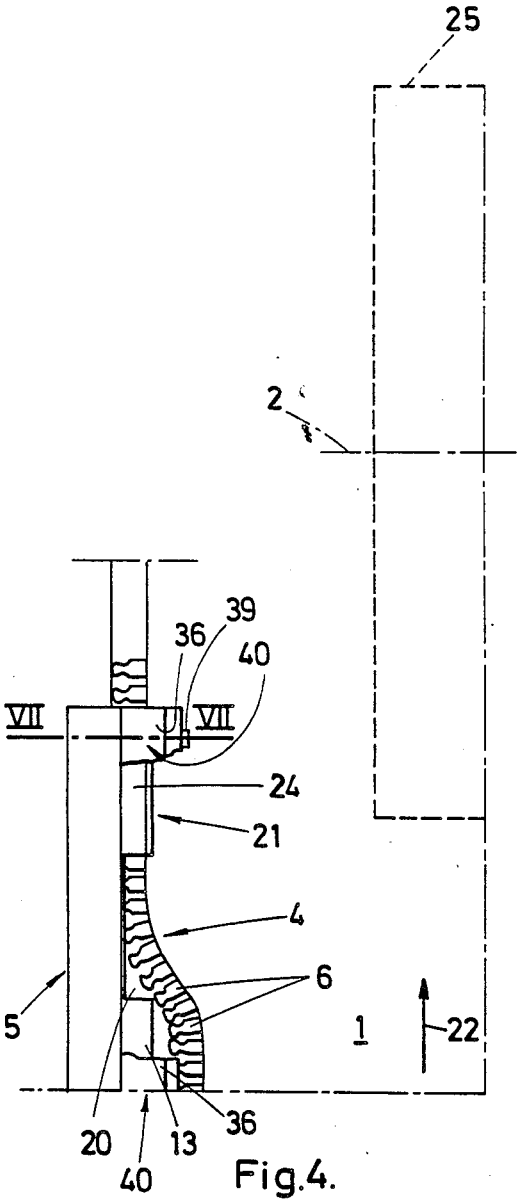
FIG. 4 is a view to an enlarged scale, in front elevation and with parts broken away, of a detail of the top part of FIG. 1 with part of the shutter edge disengaged from its guideway.
Figure 5:
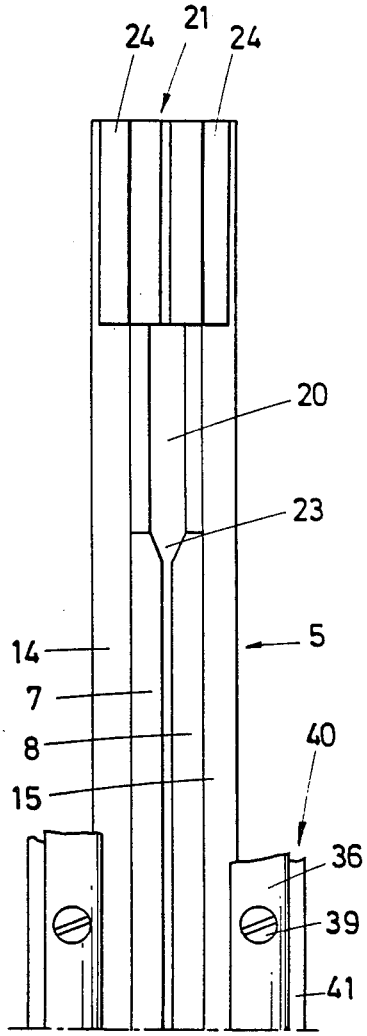
FIG. 5 is a side view with parts broken away of the same detail as shown in FIG. 4 except that the shutter has been omitted for the sake of clarity.
Figure 6:
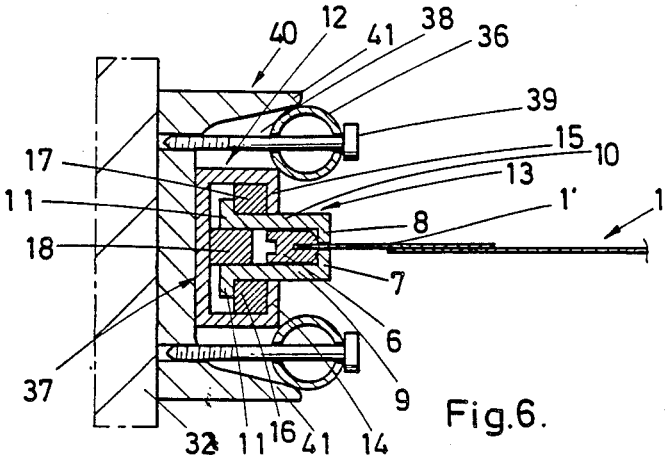
FIG. 6 is a section to an enlarged scale on the line VI—VI of FIG. 1.

As FIGS. 4 and 5 show in detail, each of the guideways 5 has in accordance with the invention in its top part an access passage 20 through which any blocks 6 which have disengaged from their guideway 5 can re-engage automatically in that part 21 thereof which is disposed immediately above the passage 20 when the shutter 1 rises, as indicated by an arrow 22 in FIG. 4 - i.e., when the winding around its spindle 2.

In the embodiment illustrated the access passage 20 is produced by cutting out over a distance of a few centimeters that part 13 of the members 9, 10 which extends beyond the support 12. It might sometimes suffice to cut just the edgings 7, 8 of the members 9, 10 to enable the shutter edges 4 to re-engage between the members 9 and 10.

According to another feature of the invention, to provide some guidance of the blocks 6 axially of the guideway 5 at the entry of the passage 20, the edgings 7, 8 which bound the bottom side of the passage 20 are formed with a V-shaped cut-out 23.

Figure 7:
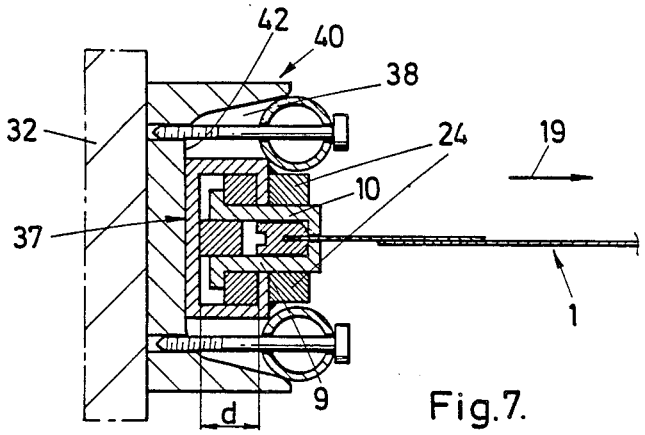
FIG. 7 is a section, also to an enlarged scale, on the line VII—VII of FIG. 4.

In the guideway part 21 the part 13 of the members 9, 10 is strengthened on its outside surfaces by stiffeners 24 which prevent the small blocks 6 from disengaging from the members 9, 10 in response to a pull in the direction indicated by the arrow 19. This feature is illustrated by FIG. 7.

Figure 8:
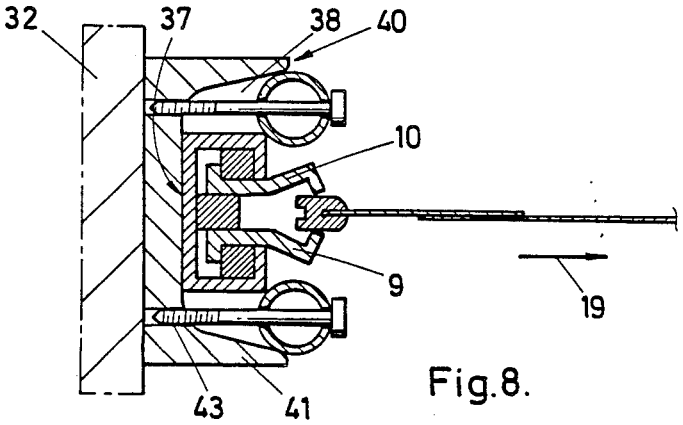
FIG. 8 is a section similar to FIG. 6 except that the shutter edge is partly disengaged from its guideway.

The point is that in the absence of the stiffeners 24 the members 9, 10 might possibly open a little as shown in FIG. 8 in the region where the blocks 6 enter the guideway part 21 upon re-engagement in the guideway.

In this connection, since the part 21 is disposed in the top part of the bay 3, the risks of any such force in the direction of the arrow 19 occurring in this zone are very slight.

Preferably, the shutter 1 winds on to a drum 25 which is of fairly large diameter and, therefore, relatively rigid and which is rotatable around the spindle 2 in the top part of the bay 3. The top free end of the two guideways 5 extends almost as far as the cylindrical drum wall so as to ensure satisfactory winding of the shutter on the drum.

Advantageously, a relatively thin strip 26 of the shutter 1 is secured by way of its top edge, for example, by sticking or riveting, to the cylindrical drum wall along the generatrix of the drum, its bottom edge being releasably connected to the remainder of the shutter, for example, by a slide fastener 27.

This may be very practicable for the installation of the device or for the replacement of the shutter.

Figure 3:
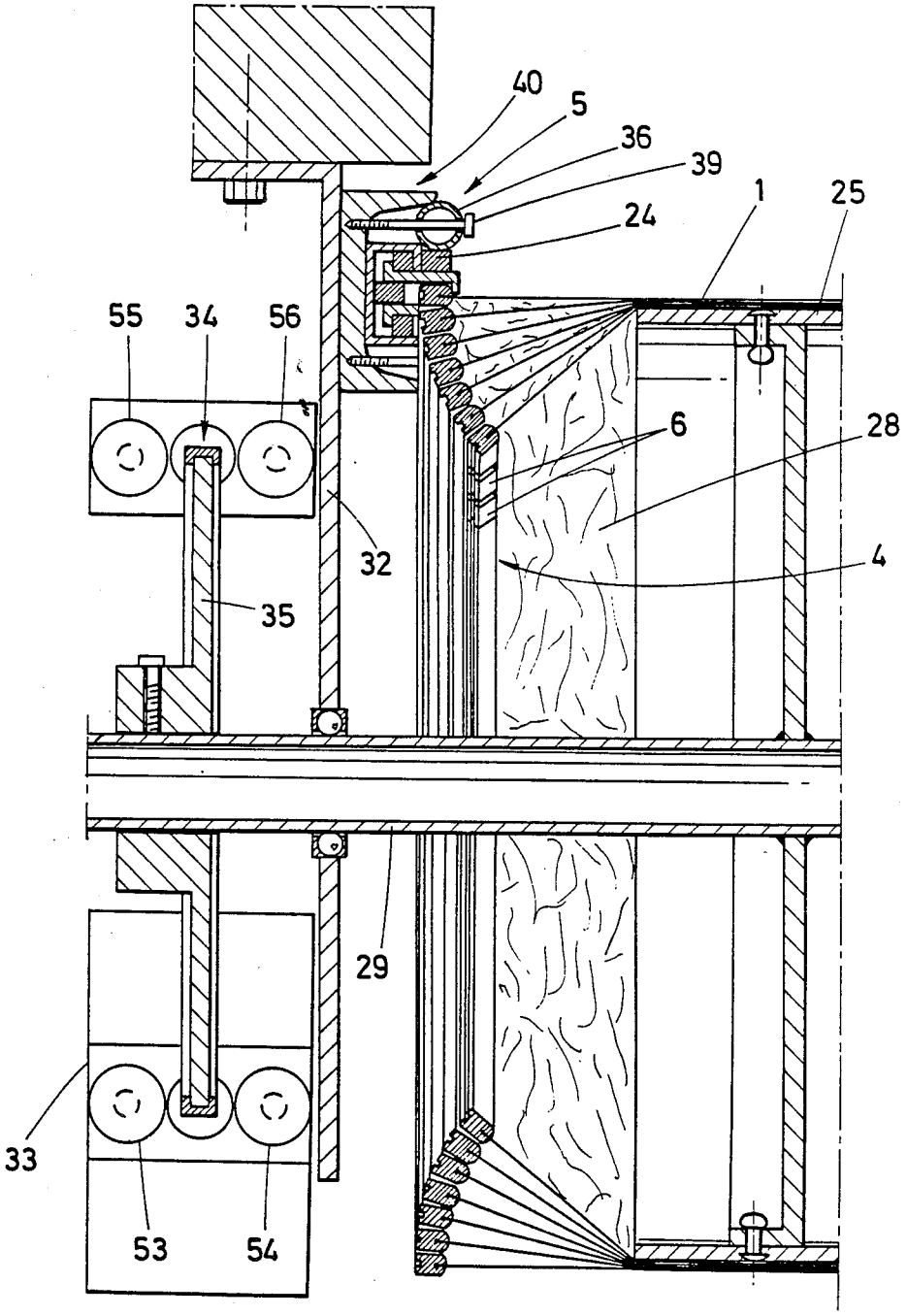
FIG. 3 is a section on the line III—III of FIG. 1 to an enlarged scale and with parts broken away.

The shutter side edges project beyond both ends of the drum 25 when the shutter winds on to the drum 25. This is shown in detail in FIG. 3.

A gap 28 is therefore left at either end of the drum 25 in extension thereof.

The longitudinal axis of the guideways extends approximately in a vertical plane tangential to the cylindrical wall of the drum on that side thereof on which the winding of the shutter 1 starts, so that according as the shutter side edges disengage from the top end of their respective guideway they can, as the shutter 1 winds on to the drum 25, wind freely around the spindle 2 and drop back into the gap 28. This feature helps to compensate for the excess thickness of the side edges of the wound shutter.

The shutter therefore remains properly stretched on the drum and the shutter surface needs no overthicknesses to compensate for the thickness difference between the blocks 6 and the shutter 1.

The guideway axis can in fact be disposed in a vertical plane tangential to the cylinder formed by half of the wound part of the shutter on the drum.

If the shutter is in the form of a tarpaulin of relatively reduced thickness, variations in the diameter of the shutter wound on the drum are also very reduced, more particularly since drum diameter itself may be relatively substantial.

Shutter-driving means are provided so that at least for winding the shutter 1 on the drum 25; preferably, the shutter bottom edge is weighted uniformly over its length to permit or facilitate unwinding of the shutter, basically by its own weight.

In the embodiment shown the shutter-driving means comprise a motor (not shown) incorporated in the drum 25.

Advantageously, the drum 25 is in the form of a hollow cylinder made of a hard plastics such as polyvinylchloride and is therefore very rigid but relatively light in weight. The drum 25 is rotatable mounted on a shaft 29. The free ends of the shaft 29 which extend beyond the drum 25 are journalled in the frame 32 formed by L-section members which bound the bay 3 laterally and on which, as previously stated, the channel-section members 40 of the guideways 5 are secured.

The shutter-driving means, more particularly the drum-driving means, also comprise a counterweight 33 suspended by a chain 34 on a sprocket 35 rigidly secured to one of the free ends of the shutter shaft 29.

The chain 34 is open and is so placed on the sprocket 35 as to be in the form of two runs **34*a*, 34*b* hanging freely on either side of the sprocket 35**.

The counterweight 33 is suspended on the chain run **34*a* so as to rise when the shutter 1 unwinds and to descend when the shutter 1 winds on around the drum 25**.

Damping means are provided to damp the movement of the shutter 1 a little before it reaches its fully wound and fully unwound positions. To this end, in the embodiment illustrated, more particularly in FIG. 2, the damping means comprise at each end of travel of the chain 34 near the sprocket 35 two air dampers 53–56 extending in pairs on either side of the chain runs **34*a*, 34*b*. Each damper has a piston rod 57** which moves in a cylinder and which extends through the cylinder base parallel to the chain runs and has a plate on its free end.

Abutment elements 58, 59 are provided on each of the chain runs **34*a*, 34*b* for engaging the plates on the ends of the corresponding piston rods 57 when the runs rise to push the rods back into their corresponding cylinders and compress the air therein, thus producing gradual damping or retardation of the movement of the shutter 1**.

Also, the piston rods 57 engaged by the elements 58, 59 can activate switches 60, 61 disposed in the motor supply circuit and arranged along the path of the runs **34*a*, 34*b*** respectively so as to switch off the motor when the dampers are providing retardation.

It has been found convenient in practice to switch off the motor substantially at the start of retardation of the shutter.

It would of course be possible to use separate elements acting on the switches.

In the embodiment shown the weighted bottom edge of the shutter 1 is embodied by a steel bar disposed in a recess 50 on the bottom edge of the shutter 1. The recess 50 can also receive below the steel bar a flexible cushion 51, for example, of foam, to provide sealing tighteness between the shutter 1 and the ground 52 bounding the bottom side of the base 3 when the shutter 1 is in its fully unwound position as shown in FIGS. 1 and 2.

Figure 2:
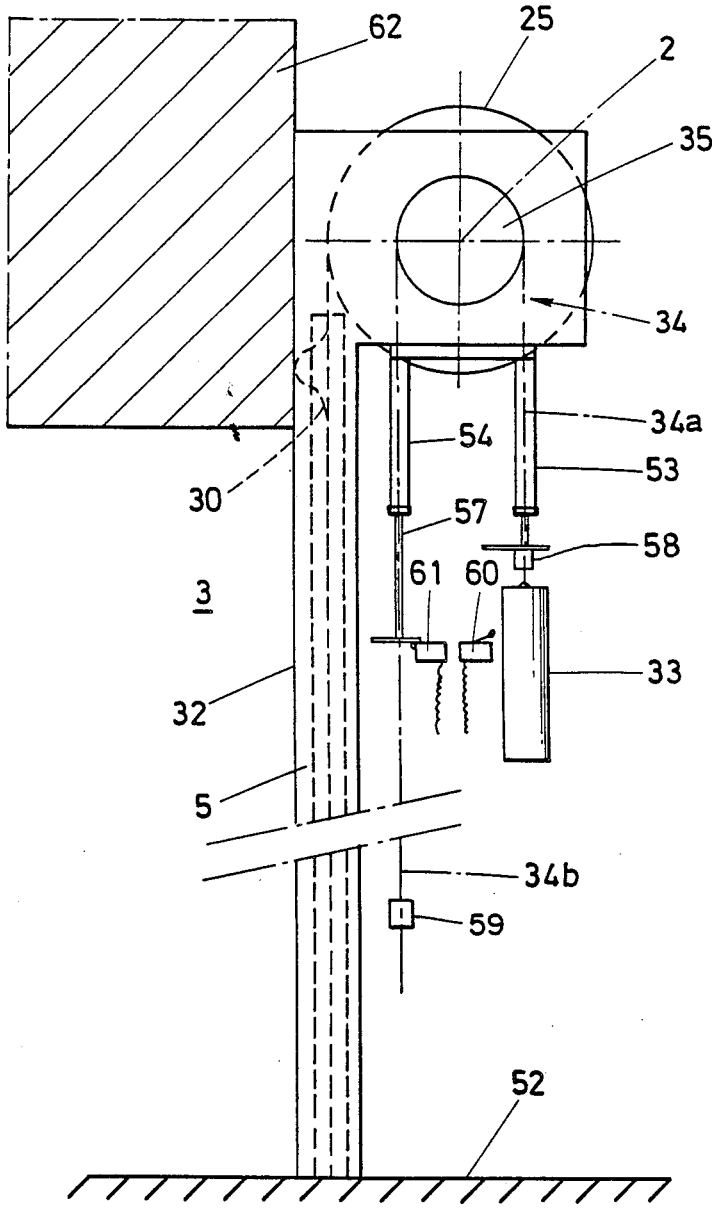
FIG. 2 is a view in side elevation of the same embodiment, to an enlarged scale.

Finally, to provide sealing-tightness in the top part of the bay 3 when the shutter 1 is in its closed position a bead 30 is engaged over substantially the whole width of the shutter outside surface slightly above the level of the lintel 62 bounding the top side of the bay 3 when the shutter is completely unwound (see FIG. 2).

The invention is not of course limited to the embodiment described and shown in the accompanying drawings and can be varied in many ways without departure from the scope of the invention.

For example, the small blocks 6 could be replaced, for example, by a continuous flexible bead possibly in the form of a cord secured along the whole length of the shutter side edges, while the guideway 5 could be a channel-section member with edges bent towards one another, the projecting part 4 of the shutter side edges sliding, for example, directly in the guideway 5.

The drum-driving means could take the form of a motor and transmission disposed outside the drum or of a spiral spring disposed in the drum and acting on the shaft 29, the spring being cocked when the shutter unwinds and thus facilitating or initiating the winding of the shutter, or just by a counterweight.

The shutter device could also be used not only to close window or door bays but, for example, also as as retractable partition in a room or to cover swimming pools and to close silos or tanks.

What is claimed is:

1. A device having a shutter secured to and windable around and unwindable from a rotatable drum and adapted to close an opening by the unwinding of the shutter substantially into a plane, the shutter having flexible side marginal edge portions which project beyond the ends of the drum and each include a series of small closely-spaced flexibly-interconnected substantially rigid substantially identical blocks of greater thickness than that portion of the shutter adjacent thereto laterally inward thereof, said blocks being retained in substantially continuous guideways during the unwinding and winding up of the shutter, the guideways having means incorporated therein at least intermediate the length thereof to enable the blocks to disengage from the guideways when subjected to a predetermined pull substantially transverse to guideway length, each guideway having near but spaced from the drum an access passage through which any blocks which are disengaged from the guideway can reengage the guideway as the shutter winds around the drum.

2. A device according to claim 1 wherein each guideway has two spaced longitudinal edgings with the portion of the shutter adjacent the blocks extending therebetween and with the edgings engaging around the blocks retained in the guideway and the access passage is formed by omitting the longitudinal edgings over a portion of the length of the guideway.

3. A device according to claim 2 wherein the entrance end of the access passage is gradually widened substantially in a V-shape by an inclined recess in the longitudinal edgings to guide and center any disengaged block in alignment with the space between the edgings to reenter the guideway.

4. A device according to claim 1 wherein the portion of each guideway extending from the corresponding access passage toward the drum includes means to substantially inhibit disengagement of the corresponding blocks in response to a pull substantially transverse to guideway length.

5. A device having a shutter secured to and windable around and unwindable from a rotatable drum and adapted to close an opening by the unwinding of the shutter substantially into a plane, the shutter having flexible side marginal edge portions which project beyond the ends of the drum and each include a series of small closely-spaced flexibly-interconnected substantially rigid substantially identical blocks of greater thickness than that portion of the shutter adjacent thereto laterally inward thereof, said blocks being retained in substantially continuous guideways during the unwinding and winding up of the shutter, each guideway including two separate somewhat resilient members and means supporting said members, said members defining two spaced facing longitudinal edgings having opposed surfaces parallel to the plane, said edgings defining right angle corners with portions of the members extending laterally outward of the shutter, the portion of the shutter adjacent the corresponding blocks extending between those surfaces and the corners engaging around the corresponding blocks, the resilience of said members enabling the blocks to disengage from the guideways when subjected to a predetermined pull transverse to guideway length.

6. A device according to claim 5 wherein that portion of the members which define the edgings project out of the supporting means and including means to adjust the extent of the projection.

7. A device according to claim 5 wherein each member has a substantially Z-shaped cross section with oppositely extending arms connected by a leg, one of the arms being at right angles to the leg and forming therewith one of the corners and one of the longitudinal edgings while the other arm is engaged within the supporting means which is a channel-section member whose side walls have spaced facing edgings along the free edges of the side walls and between which latter edgings the legs of the Z-members extend, the other arms of the Z-members being retained in the channel-section member by at least one intermediate member clamped between the legs of the two Z-members.

8. A device according to claim 7 wherein there is a gap between the base of the channel-section member and the edgings thereof which is greater than the thickness of the other arms of the two Z-members to enable the distance between the one arms and the channel-section member to be adjustable.

9. A device according to claim 5 including at least one clamping element which extends along the supporting means and which bears adjustably thereon at least laterally so that the pull required to disengage the blocks from the guideways can be adjusted.

10. A device according to claim 9 wherein the supporting means is in the form of a channel-section member the free ends of the side walls thereof having spaced facing edgings with the two separate members extending therebetween and including a channel wherein the channel-section member is disposed with gaps between the side walls thereof and those of the channel, there being two clamping elements one disposed in each gap and including means securing the elements at an lateral pressure can be applied to the free ends of the side walls of the channel-section member and the pressure of the supporting means on the two separate members can be adjusted.

11. A device according to claim 10, wherein the clamping element is a substantially cylindrical rod secured by screws extending right through the rod into the base of the channel.

12. A device according to claim 5 wherein the guideways extend substantially in a plane tangential to the drum on that side thereof wherein the shutter starts to be wound onto the drum.

13. A device according to claim 5 wherein the shutter, at least between the flexible side marginal edge portions, is a tarpaulin.

14. A device having a shutter windable around and unwindable downward from a drum coaxially secured to a horizontal rotatable shaft and adapted to close an opening by the unwinding of the shutter, comprising a wheel secured to the shaft beyond one end of the drum, wheel diameter being less than drum diameter, a counterweight so cooperating with the wheel as to rise when the shutter unwinds and to descend when the shutter winds onto the drum, and including damping means to retard shutter movement a little before the shutter reaches its wound and fully wound positions.

15. A device according to claim 14 wherein the shaft is driven by a motor to wind up and unwind the shutter and including a switch to switch off the motor during retardation of shutter movement by the damping means.

16. A device according to claim 14 wherein the wheel is in the form of a sprocket having a chain trained thereover with two runs depending therefrom, the counterweight being suspended on one of the runs and including abutment elements on the runs for activating the damping means.

17. A device according to claim 14, wherein the damping means comprise air dampers.

18. A device having a shutter windable around and unwindable from a drum and adapted to close an opening by the unwinding of the shutter into a plane, the shutter having flexible side marginal edge portions which project beyond the ends of the drum and each include a series of small closely-spaced flexibly-interconnected substantially rigid substantially identical blocks of greater thickness than that portion of the shutter adjacent thereto laterally inward thereof, said blocks being retained in substantially continuous guideways during the unwinding and winding up of the shutter, each guideway including means defining a resilient section and means supporting said section, said section defining two spaced facing longitudinal edgings having opposed surfaces parallel to the plane, said edgings defining right angle corners with portions of the section extending laterally outward of the shutter, the portion of the shutter adjacent the corresponding blocks extending between those surfaces and the corners engaging around the corresponding blocks, the resilience of said section enabling the blocks to disengage from the guideways when subjected to a predetermined pull transverse to guideway length.

19. A device having a shutter secured to and windable around and unwindable from a rotatable drum and adapted to close an opening by the unwinding of the shutter substantially into a plane, the shutter having flexible side marginal edge portions which project beyond the ends of the drum and each include a series of small closely-spaced flexibly-interconnected substantially rigid substantially identical blocks of greater thickness than that portion of the shutter adjacent thereto laterally inward thereof, said blocks being retained in substantially continuous guideways during the unwinding and winding up of the shutter, the guideways extending substantially in a plane tangential to the cylindrical wall of the drum on that side thereof where the shutter starts to be wound onto the drum so that as the blocks disengage from the end of their respective guideway as the shutter winds onto the drum the marginal edge portions can wind freely around the drum axis and drop back theretowards.

20. A device having a shutter secured to and windable around and unwindable from a rotatable drum adapted to close an opening by the unwinding of the shutter substantially into a plane, the shutter having flexible side marginal edge portions each including a continuous section closely adjacent the extreme shutter edge of greater thickness than the portion of the shutter adjacent thereto laterally inward thereof, said sections being retained in substantially continuous guideways during the unwinding and winding up of the shutter, the guideways having means incorporated therein at least intermediate the length thereof to enable the sections to disengage from the guideways when subjected to a predetermined pull substantially transverse to guideway length, each guideway having near but spaced from the drum an access passage through which any parts of a section which are disengaged from the guideway can reengage the guideway as the shutter winds around the drum.

21. A device having a shutter secured to and windable around and unwindable from a rotatable drum adapted to close an opening by the unwinding of the shutter substantially into a plane, the shutter having flexible side marginal edge portions which project beyond the ends of the drum and each include a continuous section closely adjacent the extreme shutter edge of greater thickness than that portion of the shutter adjacent thereto laterally inward thereof, said sections being retained in substantially continuous guideways during the unwinding and winding up of the shutter, the guideways having means incorporated therein at least intermediate the length thereof to enable the sections to disengage from the guideways when subjected to a predetermined pull substantially transverse to guideway length, each guideway having near but spaced from the drum an access passage through which any parts of a section which are disengaged from the guideway can reengage the guideway as the shutter winds around the drum.

22. A device according to claim 21 or 20 wherein each guideway has two spaced longitudinal edgings with the portion of the shutter adjacent the section extending therebetween and with the edgings engaging around the section retained in the guideway and the access passage is formed by omitting the longitudinal edgings over a portion of the length of the guideway.

23. A device according to claim 22 wherein the entrance end of the access passage is gradually widened substantially in a V-shape by an inclined recess in the longitudinal edgings to guide and center any disengaged part of a section in alignment with the space between the edgings to reenter the guideway.

24. A device according to claim 21 or 20 wherein the portion of each guideway extending from the corresponding access passage toward the drum includes means to substantially inhibit disengagement of the corresponding section in response to a pull substantially transverse to guideway length.

25. A device according to claim 21 or 20 wherein the guideways extend substantially in a plane tangential to the drum on that side thereof wherein the shutter starts to be wound onto the drum.

26. A device according to claim 21 or 20 wherein the shutter, at least between the flexible side marginal edge portions, is a tarpaulin.

27. A device having a shutter secured to and windable around and unwindable from a rotatable drum and adapted to close an opening by the unwinding of the shutter substantially into a plane, the shutter having flexible side marginal edge portions which project beyond the ends of the drum and each include a continuous section closely adjacent the extreme shutter edge of greater thickness than that portion of the shutter adjacent thereto laterally inward thereof, said sections being retained in substantially continuous guideways during the unwinding and winding up of the shutter, the guideways extending substantially in a plane tangential to the cylindrical wall of the drum on that side thereof where the shutter starts to be wound onto the drum so that as the sections disengage from the end of their respective guideway as the shutter winds onto the drum the marginal edge portions can wind freely around the drum axis and drop back theretowards.

* * * * *